US005131572A

United States Patent [19]

Spengler

[11] Patent Number: 5,131,572

[45] Date of Patent: Jul. 21, 1992

[54] JUG AND DISPENSING VALVE

[75] Inventor: William E. Spengler, Perrysburg, Ohio

[73] Assignee: Tolco Corporation, Toledo, Ohio

[21] Appl. No.: 587,773

[22] Filed: Sep. 24, 1990

[51] Int. Cl.[5] ..... B65D 47/00; B67D 3/00

[52] U.S. Cl. ..... 222/545; 222/553; 285/330; 285/373

[58] Field of Search ..... 222/185, 531, 532, 537, 222/545, 553, 105; 285/330, 331, 373, 419; 251/152, 352

[56] References Cited

U.S. PATENT DOCUMENTS

| | | | |
|---|---|---|---|
| 2,137,137 | 11/1938 | Goldacker | 285/387 X |
| 2,887,072 | 5/1959 | Watkins | 222/553 X |
| 3,041,088 | 6/1962 | Brandon, Jr. | 285/373 X |
| 3,191,810 | 6/1965 | Johnston | 222/183 |
| 3,430,824 | 3/1969 | Connors et al. | 222/523 |
| 4,126,338 | 11/1978 | Coel et al. | 285/330 |
| 4,129,236 | 12/1978 | Wrycraft et al. | 222/570 |
| 4,236,736 | 12/1980 | Anderson | 285/330 X |
| 4,343,416 | 8/1982 | Etheredge et al. | 222/1 |
| 4,446,673 | 5/1984 | Desthieux | 222/105 X |

FOREIGN PATENT DOCUMENTS

| | | | |
|---|---|---|---|
| 9005696 | 5/1990 | Fed. Rep. of Germany | 222/553 |

OTHER PUBLICATIONS

Brochure of Walton-March Inc., Highland Park, Illinois, copyrighted 1984, entitled "Big Buddy Stack Rack".

Brochure of Drackett Products Company, 5020 Spring Grove Avenue, Cincinnati, Ohio, copyrighted 1983 entitled "The Dispenser Pak TM".

Brochure entitled "Drummond TM Tower Of Power".

Brochure of Impact Products, Inc., 2840 Centennial Road, Toledo, Ohio, entitled "Stack Rack Dispensing System".

Brochure of Tolco Corporation, 1920 Linwood Avenue, Toledo, Ohio, entitled "New Tolco's Dispensing Rack", copyrighted 1985.

*Primary Examiner*—Michael S. Huppert
*Assistant Examiner*—Anthoula Pomrening
*Attorney, Agent, or Firm*—Emch, Schaffer, Schaub & Porcello Co.

[57] ABSTRACT

A jug and dispensing valve therefore in which the jug, when positioned in a dispensing position, has a threaded dispensing neck extending horizontally from a location of a side wall adjacent the bottom wall, a second neck extending horizontally from a location of said side wall near the top and a third neck extending vertically from said second neck, said third neck having an upper free end substantially co-planar with the top wall and providing access for refilling, said dispensing valve affixed to the threaded dispensing neck and including a liquid receiving member, a split threaded sleeve for securing the liquid receiving member to the jug, a collar for holding the split threaded sleeve together and a spigot for controlling the flow of liquid through the liquid receiving member.

9 Claims, 4 Drawing Sheets

JUG AND DISPENSING VALVE

BACKGROUND OF THE INVENTION

The present invention relates to a jug functioning as a dispensing container having a plurality of openings including side openings and a top opening for refilling and venting purposes and a dispensing valve engaged therewith to dispense liquid from one of said side openings.

In handling liquids, particularly in an industrial setting, it is frequently desirable to have the liquids stored in a container of a size larger than can be conveniently handled and to provide a dispensing valve near the bottom from which a small quantity of liquid can be dispensed without moving the container. It is frequently desirable that such containers have the capability of being refilled without being moved to a different position and yet to be refilled to substantially the full capacity of the container.

SUMMARY OF THE INVENTION

The container and dispensing valve combination of the present invention provides a construction which permits the container to be filled to capacity while resting on one side through one of a set of opening on an opposite side and then gripped by a handle on such opposite side and placed on a rack or other supporting means in a position such that the handle and the above openings are located on a side with one of such openings adjacent the bottom and another adjacent the top. Each of the openings is defined by a threaded neck which has a closure affixed thereto following the initial filling of the container and during shipment. Prior to positioning the container so that such openings are located on the side, a dispensing valve of the type described and claimed herein is affixed to the threaded neck located adjacent the bottom of such container. In order to refill such container without moving it, a third opening is provided defined by a neck which extends upwardly, preferably as an integral extension out of the side of the upper of the threaded necks. During dispensing, the closure on the third neck is loosened to provide for venting means as the liquid is dispensed through the dispensing valve attached to the lower neck.

The dispensing valve of the present invention includes a dispensing tube and a threaded sleeve for securing the tube to the container dispensing neck. It has a new and novel design which permits the threaded sleeve portion thereof to rotate independently of the dispensing tube thereby permitting the dispensing tube to become sealingly engaged to the neck in any desired rotatable position, usually vertically, so that liquid flowing may be directed as desired. In the preferred embodiment the sleeve is formed with a longitudinal split and integral hinges about which the split sections may be pivotally opened and closed. A collar is provided to hold the sections of the split sleeve together. Means are provided for opening and closing the flow of liquid from the dispensing tube.

DETAILED DESCRIPTION OF INVENTION

Figure 1:
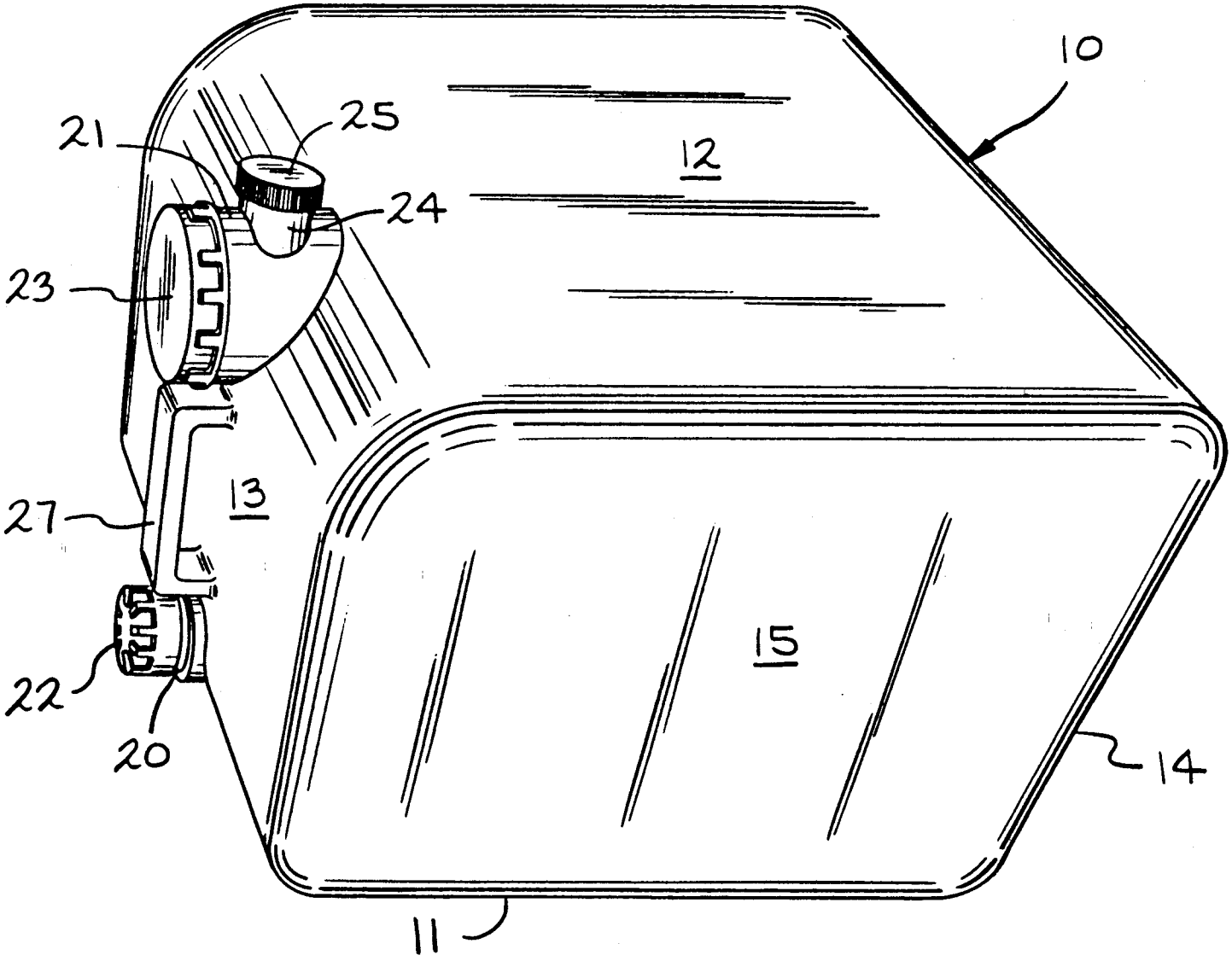
FIG. 1 is a perspective view of the container of the present invention.
Figure 2:
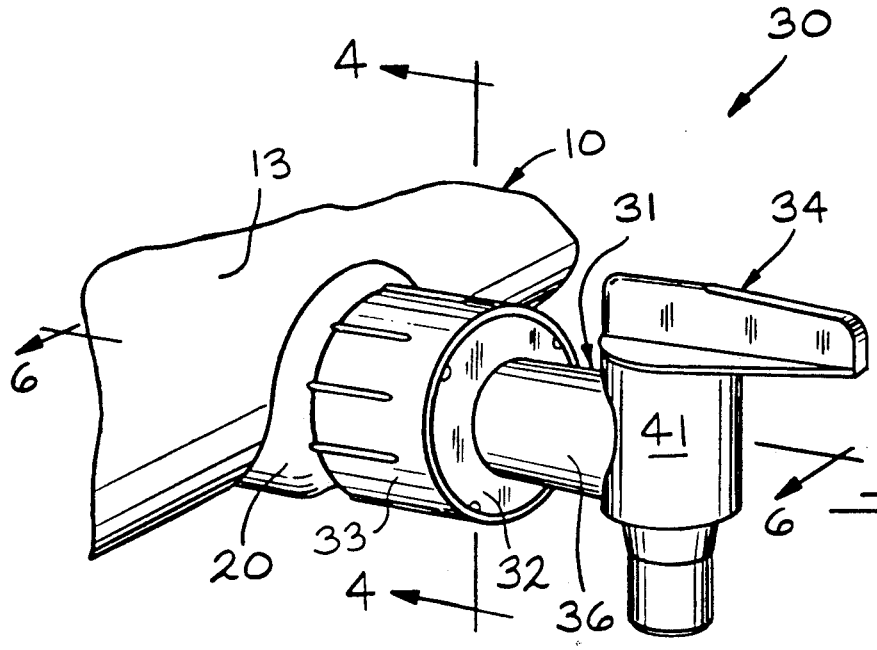
FIG. 2 is a perspective view showing a fragment of the container of FIG. 1 with the valve of the present invention secured to the lower neck.

Referring now to FIG. 1. there is shown a jug generally designated by the numeral 10 having a bottom 11, top 12, front wall 13, back wall 14 and a pair of side walls 15. Preferably, the bottom 11 and back wall 14 are either flat or other contour which will permit the jug 10 to be stable when resting on either of such surfaces. The jug may be blow molded from one of a variety of plastic materials such as high density polyethylene.

The jug 10 has a first threaded neck 20 extending from the front wall 13 at its juncture with the bottom 11 and a second threaded neck 21 extending from said front wall 13 near the top 12. The first threaded neck 20 and second threaded neck 21 are each disposed along an axis substantially parallel to the bottom. The first threaded neck 20 is provided with a first threaded closure 22 and the second threaded neck is 21 provided with a second threaded closure 23. Thus, each of the first threaded neck 20 and the second threaded neck 21 are disposed in a horizontal position when the jug 10 is resting with its bottom 11 on a horizontal surface. The back wall 14 is substantially normal to the bottom 11 so that the first threaded neck 20 and second threaded neck 21 will be disposed in a vertical position when the jug 10 is positioned with its back wall 14 resting upon a horizontal support.

Extending upwardly from the second threaded neck 21 at right angles thereto is a third threaded neck 24 having a third closure 25 affixed thereto. Thus, when the jug is resting upon its bottom 11, the third threaded neck 21 is extending vertically upwardly out of the second threaded neck 21 and the first and second threaded necks 20 and 21 are extending horizontally. Also extending from the front wall 13 is a handle 27 which is, preferably, integrally molded with the remainder of the jug 10.

During its initial filling following blow molding, the jug will normally be positioned to rest on its back wall 14 with the first threaded neck 20 and second threaded neck 21 extending vertically upwardly. It will also be transported in this position so that the handle 27 can be readily grasped. Following transfer of the jug 10 from the initial filling location to its using location, it will have the dispensing valve affixed to the first threaded neck 20 while the jug 10 is positioned with the first threaded neck 20 extending vertically upwardly. The jug 10 may then be placed with its bottom 11 resting horizontally on a rack or other supporting surface for dispensing whatever quantity of liquid is desired. The design of the jug 10 permits it to be refilled through the third threaded neck 24 without the necessity of moving it from the supporting rack of other surface upon which the bottom 11 is resting. Preferably, the major portion of the top 12 is planar and the top of the third threaded neck 24 lies substantially in the plane defined by the major portion of said top 12. This permits the jug 10 to be completely filled through such third threaded neck 24 when it is resting on the bottom 11.

During dispensing, it will be desirable to loosen the third threaded closure 25 to provide vent means through the third threaded neck 24.

Referring now to FIGS. 2-7, the jug 10 has affixed to the first threaded neck 20 a dispensing valve generally designated by the numeral 30. The dispensing valve 30 includes a liquid receiving member 31, a split threaded sleeve 32, a collar 33 and a spigot 34. The parts of the dispensing valve 30 may be injection molded from one or more of a variety of plastic material such as polypropylene or low density polyethylene.

If desired, an annular gasket 35 (See FIGS. 6 and 7) may also be provided to assist in providing a liquid tight seal between the dispensing valve 30 and the first threaded neck 20.

Figure 8:
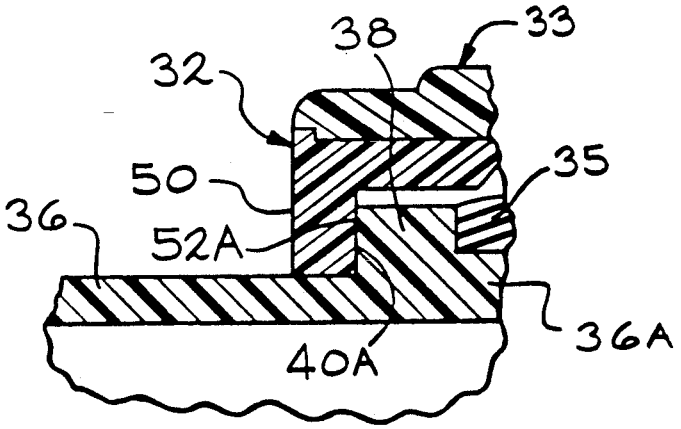
FIG. 8 is a fragmentary sectional view showing a modified embodiment.
Figure 6:
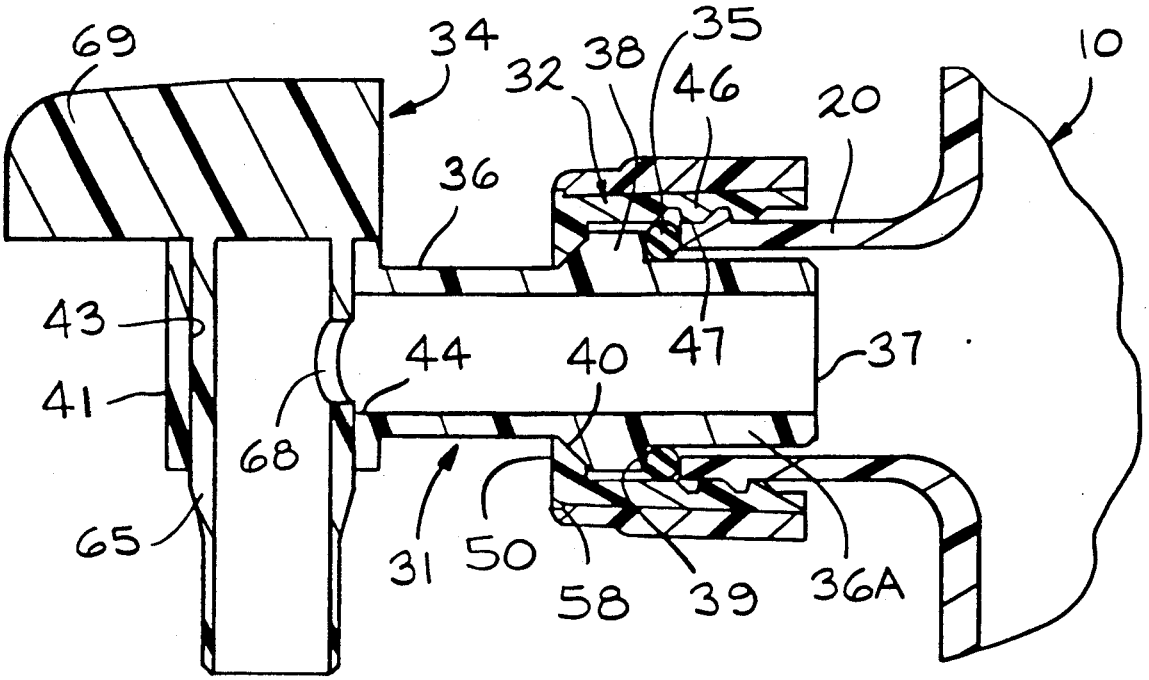
FIGS. 6 and 7 are sectional views taken through line 6—6 of FIG. 2 with FIG. 6 showing the valve sealingly engaged to the neck of the jug and FIG. 7 showing the position of the valve as it is being affixed to the neck of the jug.
Figure 7:
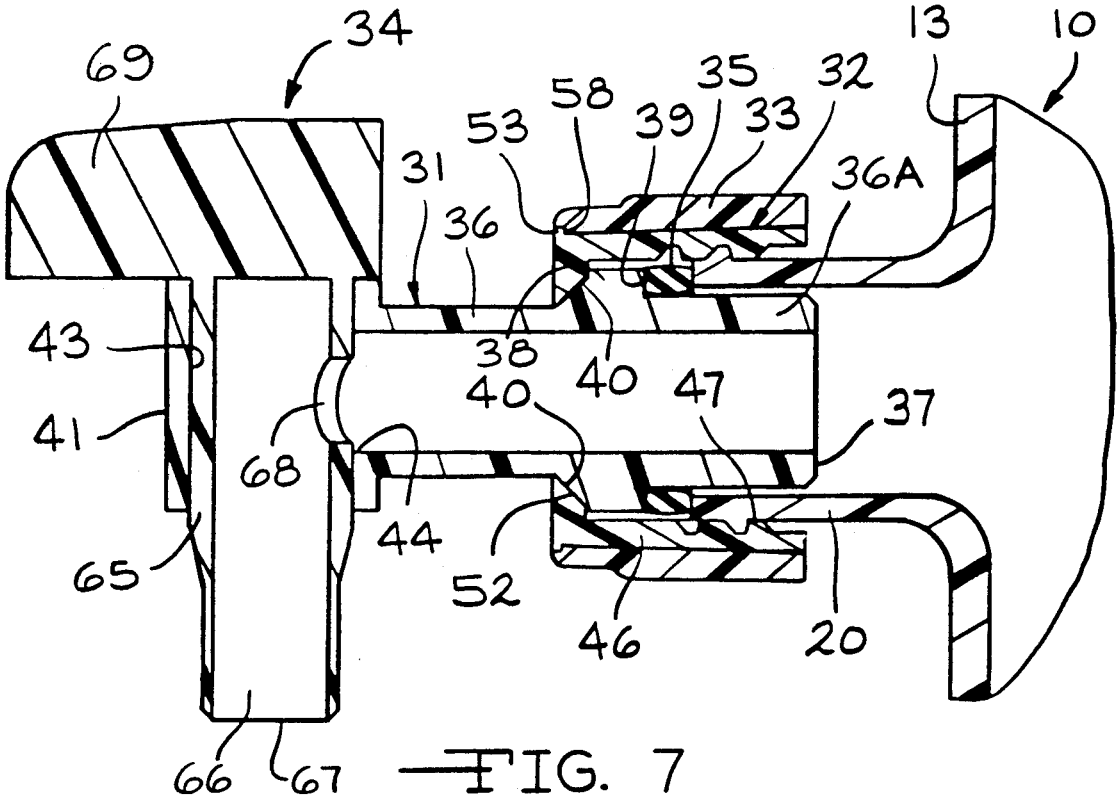

The liquid receiving member 31 includes a first tubular segment 36 having a free end portion 36A which is sized to fit into the first threaded neck 20 of the jug 10 and terminating in an end 37. Spaced from the end 37 is an enlarged shoulder 38 having a diameter larger than the internal diameter of the first threaded neck 20. The enlarged shoulder 38 has a forward surface 39 facing toward the end 37 lying in a plane substantially perpendicular to the axis of the end portion 36A and sized to engage either the end of the threaded neck 20 or, if desired, an annular gasket 35 positioned therebetween. The enlarged shoulder 38 also includes a tapered surface 40 defining a frustum of a cone facing away from the end 37. If desired, as shown in FIG. 8, the enlarged shoulder 38 may have a surface 40A facing away from the end 37 which is perpendicular to the axis of the end portion 36A.

The liquid receiving member 31 also includes a second tubular segment 41 integrally formed with the first tubular segment 36. The second tubular segment 41 lies on an axis substantially perpendicular to the axis of the first tubular segment 36. The second tubular segment 41 has an inner cylindrical wall 43 with an aperture 44 providing communication between the tubular segment 36 and the chamber defined by the inner cylindrical wall 43.

Figure 3:
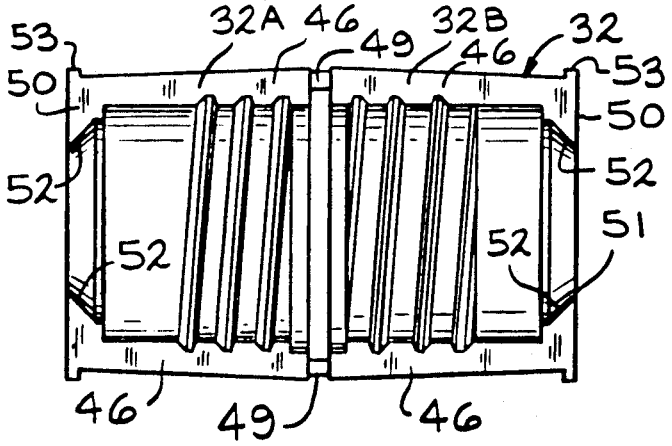
FIG. 3 is a plan view of the split threaded sleeve in the open position in which it is molded.
Figure 4:
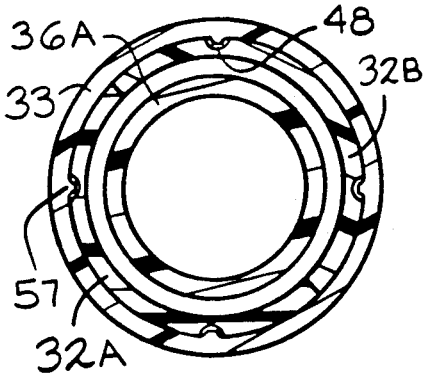
FIG. 4 is a sectional view taken through line 4—4 of FIG. 2.

Telescoped over the free end portion 36A and the shoulder 38 of the tubular segment 36 is the threaded sleeve 32. In the preferred embodiment, the threaded sleeve 32 is split longitudinally with two halves 32A and 32B which, when folded together, cooperate to form an annular wall 46 having an internal thread 47 engageable with the thread of the threaded neck 20 of the jug 10. The exterior surface of the wall 46 is formed with a plurality of longitudinal grooves 48 or other surfaces irregularity. (See FIGS. 4 and 5). Preferably, the halves 32A and 32B of the threaded sleeve 32 are joined by integrally formed hinges 49 located at one end of the wall 46. This construction permits the threaded sleeve 32 to be molded in one piece in an open position as shown in FIG. 3.

Figure 5:
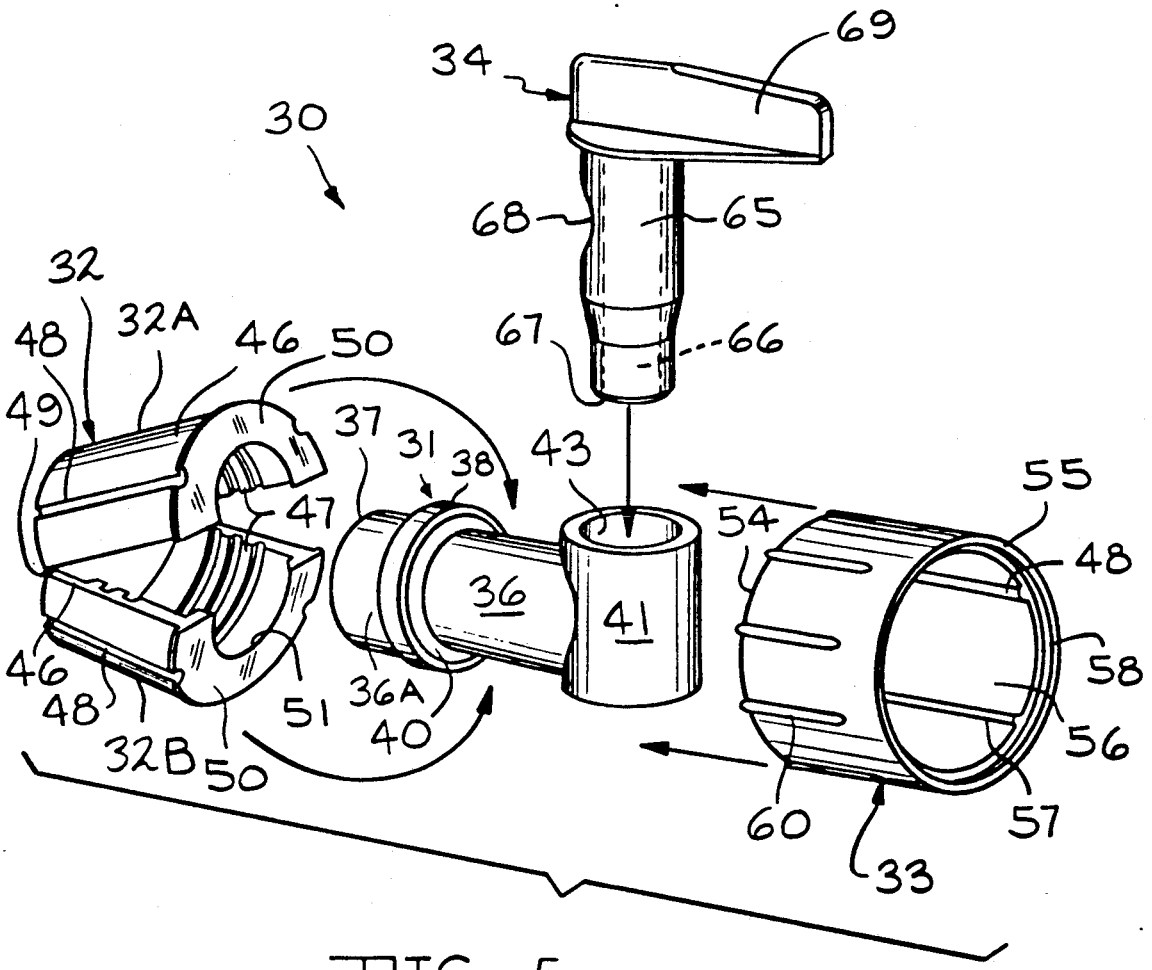
FIG. 5 is an exploded view showing the various components of the valve.

The end of the threaded sleeve 32 opposite the hinges 49 has a radially outwardly extending bead 53 and a radially inwardly directed wall 50 having a cutout area 51 which is at least as large in diameter as the diameter of the portion of the first tubular segment 36 between the shoulder 38 and the second tubular. segment 41 but smaller in diameter than the shoulder 38. The diameter of the inner surface of the wall 46 is at least as large, and preferably slightly larger than the diameter of shoulder 38. The radially inwardly directed wall 50 includes an inwardly facing tapered surface 52 which is engageable with the tapered surface 40 of the enlarge shoulder 38. Thus, as shown in FIG. 5, the threaded sleeve 32 may be slipped over the shoulder 38 by opening the halves 32A and 32B about the hinges 49 sufficiently to permit the wall 50 to pass over the shoulder 38. The havles 32A and 32B of the threaded sleeve 32 are then closed therearound. Preferably, the exterior surface of the wall 46 of the split sleeve 32 is slightly tapered such that the end adjacent the hinge 49 is slightly greater in diameter than the bead 53. In the embodiment shown in FIG. 8, the radially inwardly directed wall 50 has an inner surface 52A perpendicular to the axis of the end portion 36A which is engageable with the surface 40A of the enlarged shoulder 38.

In order to retain the halves 32A and 32B of the threaded sleeve 32 together after being positioned over the shoulder 38, an annular collar 33 is provided having an interior wall 56 sized to be telescoped over the split threaded sleeve 32. The interior wall 56 of the collar 33 has longitudinally extending splines 57 formed therein which engage the grooves 48 of the threaded sleeve 32. The collar has a forward end 54 and a rear end 55. The rear end 55 is provided with a shoulder 58 which engages the radially outwardly extending annular bead 53 of the sleeve 32. If desired, the collar 33 may be provided exteriorly disposed longitudinal ribs 60 which assist in gripping the collar for ratation.

The interior wall 56 of the collar 33 is tapered with the diameter of the interior wall 56 at the forward end 54 intended to be adjacent the hinge 49 of the sleeve 32 when assembled, having a diameter slightly greater than the diameter of the outside of the bead 53 and substantially the same size as or even slightly smaller than the diameter of the outside diameter of the wall 46 at its hinged end. The diameter of the interior wall 56 at the rear end 55 adjacent the shoulder 58 is slightly smaller than the outside diameter of the bead 53 and of the wall portion 46 immediately adjacent thereto. Since the diameter of the bead 53 is smaller than the interior wall 56 at the forward end 54, the collar 33 may be readily slipped over the beaded end of the threaded sleeve 32 and become snugly engaged with the exterior surface of the wall 46 as it is moved toward the hinged end. In view of the stretchability of the plastic material from which these parts are molded, polypropylene or low density polyethylene, the collar 33 may become fully engaged with the threaded sleeve 32 even though the bead 53 has a slightly larger diameter than the diameter of the interior wall portion adjacent the shoulder 58 with the result that, upon full engagement, t the bead 53 will snap into locking engagement with the shoulder 58.

As can be seen in FIG. 5, in assembling the threaded sleeve 32 and the collar 33 to the liquid receiving member 31, the halves 32A and 32B are opened so that the threaded sleeve 32 can be positioned over the enlarged shoulder 38 of tubular segment 36. The respective halves 32A and 32B are then pivoted about the hinges 40 to a closed position and the collar 33 is slipped over the second tubular segment 41 of the liquid receiving member 31 and into engagement with the threaded sleeve 32, with the splines 57 aligned to fit within the grooves 48. As will be readily apparent, the size of the second tubular segment 41 cannot exceed the smallest opening of the interior wall 56 of the collar 33.

The final portion of the valve member 30 is the spigot 34 having a tubular section 65 sized to fit snugly in the second tubular segment 41 of the liquid reeiving member 31 and to be in rotatable engagement with the inner cylindrical wall 43. The tubular section 65 has a longitudinal passageway 66 extending to a lower outlet 67 and an integral handle 69. The tubular section 65 also includes an aperture 68 extending through the wall which, is longitudinally aligned with the opening 44 at the outlet end of the tubular end segment 36. (See FIGS. 6 and 7). The spigot 34 may be rotated by the handle 69 between an open position in which the aperture 68 aligned with the opening 44 to a closed position with the aperture 68 positioned away from the opening 44 so that flow through the opening 44 is blocked by the exterior surface of the tubular section 65.

When it is desired to affix the valve 30 to the neck 20 of the jug 10, the collar 33 is simply rotated causing the threaded sleeve 32 with its internal threads 47 to engage the threads of the neck 20. Such engagement causes the tapered sealing surface 52 of the annular wall 50 to engage the tapered surface 40 of the shoulder 38 and move the threaded sleeve 32 toward the end of the neck 20 causing the gasket 35 to be sealingly clamped between the end of the threaded neck 20 and the forward surface 39 of the enlarged shoulder 38. In the embodiment shown in FIG. 8, engagement of the internal threads 47 to the threaded neck 20 results in the inner surface 52A of the radially inwardly directed wall 50 engaging the surface 40A of the shoulder 38 thereby causing the gasket 35 to become sealingly clamped between the end of the threaded neck 20 and the forward surface of the enlarge shoulder 38.

As will be appreciate, it is desirable that the second tubular segment be aligned vertically so that the passageway 66 is vertical when the valve 30 is engaged to the neck 20 of the jug 10. The construction of the valve 30 of the present invention permits the split threaded sleeve 32 to threadedly engage a threaded neck without the necessity of rotating the liquid receiving member 31 while the threaded sleeve 32 and collar 33 are being rotated into sealing engagement with such neck. Thus, the passageway 66 may always be maintained in a vertical or any other desired position.

Although the preferred embodiment of the present invention utilizes a split threaded sleeve and a collar in combination with such sleeve, the feature of providing a sleeve which may be rotated into threaded engagement with the threaded neck of a container without requiring that the liquid receiving member 31 and its second tubular segment 41 also be rotated can be accomplished by providing other means to hold the sections 32A and 32B of the split threaded sleeve 32 together. Thus, the sections 32A and 32B could be heat sealed together following assembly ever the enlarge shoulder 38. Alternatively, an annular band could encircle the threaded sleeve of the end opposite the hinges 49.

Accordingly, the scope of the present invention should be limited only by the scope of the appended claims.

I claim:

1. Apparatus for dispensing liquids from supply means having a neck with a dispensing opening comprising in combination:

(a) a first member for receiving liquid from said dispensing opening, said first member including;

(i) a first tubular segment having an inlet end sized to fit which and receive liquid from said dispensing opening and an outlet end, said first tubular segment defining a passageway extending along an axis in a first direction, and having sealing means engageable with said supply means; and, (ii) a second tubular segment extending from said outlet end along an axis in a second direction and having a wall defining a chamber having an inner cylindrical surface and upper and lower openings, said wall having an aperture providing communication between said passageway and said chamber;

(b) a sleeve encircling said first tubular segment in spaced relationship at said inlet end, said sleeve being rotatable relative to said first tubular segment and being split longitudinally to form first and second sections joined together at the end encircling the inlet end by a pair of integral hinges, said first and second sections being pivotal about said hinges between an open spaced apart position and a closed position, said sleeve having, (i) first retention means formed thereon for engaging said supply means to provide communication between said dispensing opening and said inlet end of said first tubular segment;

(ii) second retention means engageable with said first tubular segment to retain said first tubular segment in sealing engagement with said supply means when said first retention means is engaged to said supply means; and, (iii) an exterior wall having at least one surface irregularity formed thereon;

(c) a collar engaging the outer surface of said sleeve, said collar having means thereon engaged with the irregularity of said sleeve to cause said sleeve to rotate when the collar is rotated; and, (d) a valve means positioned in the chamber of said second tubular segment, said valve means being movable from a closed position blocking the flow of liquid out of said outlet end of the first tubular segment to an open position permitting such flow.

2. Apparatus for dispensing liquids from supply means having a threaded neck terminating in a free end defining a dispensing opening comprising in combination:

(a) a first member for receiving liquid from said dispensing opening, said first member including;

(i) a first tubular segment having an inlet end sized to fit within said dispensing opening and an outlet end and defining a passageway extending along an axis in a first direction, said first tubular segment having an enlarged shoulder with a first sealing surface facing toward said inlet end and sized to become sealingly engaged with said neck free end when said inlet end is positioned within said dispensing opening and a second surface facing away from said inlet end; and, (ii) a second tubular segment extending from said outlet end and having a wall defining a chamber having an inner cylindrical surface and upper and lower openings, said wall having an aperture providing communication between said passageway and said chamber, said inner cylindrical surface lying on an axis substantially perpendicular to the axis of said of said passageway;

(b) a sleeve encircling said first tubular segment in spaced relationship at said inlet end, said sleeve being rotatable relative to said first tubular segment and being split longitudinally to form first and second sections joined together at the end encircling the inlet end by a pair of integral hinges, said first and second sections being pivotal about said hinges between an open spaced apart position and a closed position, said sleeve having, (i) an interior wall with threads formed thereon for engaging said threaded neck;

(ii) an inwardly directed end wall having a surface engaged to the second surface of the enlarged shoulder of said first tubular segment when the sleeve is engaged to said threaded neck;

(iii) an exterior wall having at least one surface irregularity formed thereon; and, (c) a collar snugly engaging the outer surface of said sleeve, said collar having means thereon engaged with the irregularity of said sleeve to cause said sleeve to rotate when the collar is rotated; and, (d) valve means positioned in the chamber of said second tubular segment, said valve means being movable from a closed position blocking the flow of liquid out of said outlet end of the first tubular segment to an open position permitting such flow.

3. Apparatus for dispensing liquids from supply means having a neck with a dispensing opening comprising in combination:

(a) a first member for receiving liquid from said dispensing opening, said first member including;

(i) a first tubular segment having an inlet end sized to fit within and receive liquid from said dispensing opening and an outlet end, said first tubular segment defining a passageway extending along an axis in a first direction, and having an enlarged shoulder with a sealing surface engagebale with said supply means and a second surface facing away from said inlet end; and, (ii) a second tubular segment extending from said outlet end along an axis in a second direction and having a wall defining a chamber having an inner cylindrical surface and upper and lower openings, said wall having an aperture providing communication between said passageway and said chamber;

(b) a sleeve encircling said first tubular segment in spaced relationship at said inlet end, said sleeve being rotatable relative to said first tubular segment and being split longitudinally to form first and second sections joined together at the end encircling the inlet end by a pair of integral hinges, said first and second sections being pivotal about said hinges between an open spaced apart position and a closed position, said sleeve having, (i) retention means formed thereon for engaging said supply means such that liquid flows from said dispensing opening into said inlet end of said first tubular segment;

(ii) an inwardly directed end wall having a surface engageable with the second surface of said first tubular segment enlarged shoulder when said retention means is engaged to said supply means; and, (iii) an exterior wall having at least one surface irregularity formed thereon;

(c) a collar engaging the outer surface of said sleeve, said collar having means thereon engaged with the irregularity of said sleeve to cause said sleeve to rotate when the collar is rotated; and, (d) valve means positioned in the chamber of said second tubular segment, said valve means being movable from a closed position blocking the flow of liquid out of said outlet end of the first tubular segment to an open position permitting such flow.

4. in combination (A) liquid supply means having a threaded neck terminating in a free end defining a dispensing opening; and, (B) a dispensing valve attached to said neck, said dispensing valve having, (a) a first member for receiving liquid from said dispensing opening, said first member including;

(i) a first tubular segment having an inlet end positioned within said dispensing opening and an outlet end and defining a passageway extending along an axis in a first direction, said first tubular segment having an enlarged shoulder with a first sealing surface facing toward said inlet end and sealingly engaged with said neck and a second surface facing away from said inlet end; and, (ii) a second tubular segment extending from said outlet end and having a wall defining a chamber having an inner cylindrical surface and upper and lower openings, said wall having an aperture providing communication between said passageway and said chamber, said inner cylindrical surface lying on an axis substantially perpendicular to the axis of said passageway;

(b) a sleeve encircling said first tubular segment in spaced relationship at said inlet end, said sleeve being rotatable relative to said first tubular segment and being split longitudinally, said sleeve having (i) an interior wall with thread means formed thereon engaged to said threaded neck;

(ii) an inwardly directed end wall having a surface engaged to the second surface of the enlarged shoulder of said first tubular segment;

(iii) an exterior wall having at least one surface irregularity formed thereon and tapering from a smaller to a larger size toward said neck;

(c) a collar snugly engaging the outer surface of said sleeve, said collar having an interior wall with means thereon engaged with the irregularity of said sleeve to cause said sleeve to rotate when the collar is rotated and tapering from a smaller size to a larger size toward said neck; and, (d) valve means positioned in the chamber of said second tubular segment, said valve means being movable from a closed position blocking the flow of liquid out of said outlet end of the first tubular segment to an open position permitting such flow.

5. The combination according to claim 4, wherein said sleeve exterior wall has a plurality of surface irregularities comprising a plurality of longitudinal grooves and said collar has a plurality of longitudinal splines engaged in said grooves.

6. The combination according to claim 4, wherein said sleeve has a radial bead extending outwardly to a size smaller than the size of said collar interior wall at the end toward said neck but larger than the size of said collar interior wall at the end spaced from said neck and an annular recess extending radially outwardly from the interior wall of said collar at the end away from said neck, said annular recess sized to receive said sleeve radial bead.

7. In combination, (A) liquid supply means having a threaded neck terminating in a free end defining a dispensing opening; and, (B) a dispensing valve attached to said neck, said dispensing valve having, (a) a first member for receiving liquid from said dispensing opening, said first member including;

(i) a first tubular segment having an inlet end positioned within said dispensing opening and an outlet end and defining a passageway extending along an axis in a first direction, said first tubular segment having an enlarged shoulder with a first sealing surface facing toward said inlet end and sealingly engaged with said neck free end and a second surface facing away from said inlet end; and, (ii) a second tubular segment extending from said outlet end and having a wall defining a chamber having an inner cylindrical surface and upper and lower openings, said wall having an aperture providing communication between said passageway and said chamber, said inner cylindrical surface lying on an axis substantially perpendicular to the axis of said passageway;

(b) a sleeve encircling said first tubular segment in spaced relationship at said inlet end, said sleeve being rotatable relative to said first tubular segment and being split longitudinally to form first and second sections joined together at the end encircling the inlet end by a pair of integral hinges, said first and second sections being pivotal about said hinges between an open spaced apart position and a closed position, said sleeve having (i) an interior wall with thread means formed thereon engaged to said threaded neck;

(ii) an inwardly directed end wall having a surface engaged to the second surface of the enlarged shoulder of said first tubular segment;

(iii) an exterior wall having at least one surface irregularity formed thereon; and, (c) a collar snugly engaging the outer surface of said sleeve, said collar having means thereon engaged with the irregularity of said sleeve to cause said sleeve to rotate when the collar is rotated; and, (d) valve means positioned in the chamber of said second tubular segment, said valve means being moveable from a closed position blocking the flow of liquid out of said outlet end of the first tubular segment to an open position permitting such flow.

8. Apparatus for dispensing liquids from supply means having a threaded neck terminating in a free end defining a dispensing opening comprising in combination:

(a) a first member for receiving liquid from said dispensing opening, said first member including:

(i) a first tubular segment having an inlet end sized to fit within said dispensing opening and an outlet end and defining a passageway extending along an axis in a first direction, said first tubular segment having an enlarged shoulder with a first sealing surface facing toward said inlet end and sized to become sealingly engaged with said neck when said inlet end is positioned within said dispensing opening and a second surface facing away from said inlet end; and, (ii) a second tubular segment extending from said outlet end and having a wall defining a chamber having an inner cylindrical surface and upper and lower openings, said wall having an aperture providing communication between said passageway and said chamber, said inner cylindrical surface lying on an axis substantially perpendicular to the axis of said passageway;

(b) a sleeve encircling said first tubular segment in spaced relationship at said inlet end, said sleeve being rotatable relative to said first tubular segment and being split longitudinally, said sleeve having (i) an interior wall with threads formed thereon for engaging said threaded neck;

(ii) an inwardly directed end wall having a surface engaged to the second surface of the enlarged shoulder of said first tubular segment when the sleeve is engaged to said threaded neck; and, (iii) an exterior wall having at least one surface irregularity formed thereon, said sleeve exterior wall tapering outwardly to a larger size at the end adjacent said neck; and (c) a collar snugly engaging the outer surface of said sleeve, said collar having an interior wall with means thereon engaged with the irregularity of said sleeve to cause said sleeve to rotate when the collar is rotated, the axial extent of said second tubular segment being such as to permit said collar to be placed thereover in order to engage said sleeve, said collar interior wall tapering outwardly to a larger size at the end adjacent said neck; and (d) valve means positioned in the chamber of said second tubular segment, said valve means being movable from a closed position blocking the flow of liquid out of said outlet end of the first tubular segment to an open position permitted such flow.

9. Apparatus according to claim 8, wherein said sleeve has a radial bead extending outwardly to a size smaller than the size of said collar interior wall at said end adjacent said neck but larger than the size of said collar interior wall at the end spaced from said neck and an annular recess extending radially outwardly from said collar interior wall at said end spaced from said neck, said annular recess sized to receive said sleeve radial bead.

* * * * *

UNITED STATES PATENT AND TRADEMARK OFFICE

CERTIFICATE OF CORRECTION

PATENT NO. : 5,131,572

DATED : July 21, 1992

INVENTOR(S) : William E. Spengler

It is certified that error appears in the above-indentified patent and that said Letters Patent is hereby corrected as shown below:

Column 6, line 2, "which" should be "within"--.

Signed and Sealed this

Seventh Day of September, 1993

Bruce Lehman

*Attest:*

BRUCE LEHMAN

*Attesting Officer*

*Commissioner of Patents and Trademarks*